United States Patent [19]

Kraus et al.

[11] Patent Number: 4,765,240

[45] Date of Patent: Aug. 23, 1988

[54] SAFETY RAIL FOR ACCIDENT PREVENTION IN ROTARY PRINTING MACHINES

[75] Inventors: Josef Kraus; Erich Wech, both of Augsburg, Fed. Rep. of Germany

[73] Assignee: M.A.N.-ROLAND Druckmaschinen Aktiengesellschaft, Augsburg, Fed. Rep. of Germany

[21] Appl. No.: 22,276

[22] Filed: Mar. 5, 1987

[30] Foreign Application Priority Data

Mar. 29, 1986 [DE] Fed. Rep. of Germany ..... 3610697

[51] Int. Cl.[4] ..... B41F 5/00

[52] U.S. Cl. ..... 101/216; 68/264

[58] Field of Search ..... 101/216, 219, 228; 100/53; 68/264; 74/609; 192/130

[56] References Cited

U.S. PATENT DOCUMENTS

| | | | |
|---|---|---|---|
| 1,519,297 | 12/1924 | Del Greco | 74/609 |
| 1,803,066 | 4/1931 | MacCafferty | 101/216 |
| 3,256,395 | 6/1966 | Grau et al. | 100/53 X |
| 3,498,217 | 3/1970 | Kletti | 100/53 X |
| 4,295,421 | 10/1981 | Abendroth et al. | 100/53 X |
| 4,454,812 | 6/1984 | Johne et al. | 101/216 |
| 4,669,380 | 6/1987 | Seib et al. | 101/216 |

FOREIGN PATENT DOCUMENTS

| | | | |
|---|---|---|---|
| 766210 | 2/1954 | Fed. Rep. of Germany | 101/216 |
| 1918173 | 4/1971 | Fed. Rep. of Germany . | |
| 1574591 | 7/1969 | France | 101/216 |
| 26265 | 2/1984 | Japan | 101/216 |

*Primary Examiner*—Charles Pearson

*Attorney, Agent, or Firm*—Frishauf, Holtz, Goodman & Woodward

[57] ABSTRACT

A safety guard rail (7) can be moved between a position adjacent a nip between two rotating cylinders (3, 4) and a remote position. The safety guard rail has flanges (8, 9) attached thereto, projecting essentially parallel to cover plates (5, 6) already present in the printing machine. The cover plates are formed with guide slits (12, 13) extending downwardly at an inclination, in which guide elements (10, 11) engage, secured to the projecting flanges which hold the safety guard rail (7). Limit switches are coupled to be engaged by the flanges and/or the guide elements to provide ON and OFF signals, in dependence on the position of the safety guard rail with respect to the nip, to inhibit printing machine operation when the guard rail is in a remote position, for example for changing of rubber blankets on the cylinders, and permitting printing machine operation only when the safety guard rail (7) is adjacent the nip to be able to carry out its safety guarding function.

20 Claims, 2 Drawing Sheets

SAFETY RAIL FOR ACCIDENT PREVENTION IN ROTARY PRINTING MACHINES

The present invention relates to rotary printing machines, and more particularly to a safety rail apparatus to prevent accidents from arising adjacent a nip formed between printing cylinders rolling off against each other.

BACKGROUND

Printing machine cylinders which are driven, and particularly large cylinders which have high inertia and roll off against each other are potentially hazardous. The cylinders are designed to draw a web, for example of paper, between themselves. This tendency to pull anything between the cylinders presents a potential operator hazard.

It has previously been proposed to protect operators, as well as the printing machine roller surfaces, by placing a guard rail in advance of the nip formed between the cylinders and through which, normally, a paper web is to be drawn. Such safety rails, also referred to as finger safety rails, require holding apparatus which, if the cylinders are located on movable bearings or trunnions, that the safety rails move with the cylinder, that is, the safety rail must always be in front of the nip, even though the position of the nip may change upon readjustment of the cylinder shafts or bearings or trunnions. German Patent No. 1,918,173 describes such an arrangement.

While the arrangement so described works well, it has been found that, in operation, dirt, sprayed ink or damping fluid or the like may deposit on the holders for the safety rail. Access to the cylinders, for example to exchange a rubber blanket on a cylinder or a plate or the like then could be impaired.

THE INVENTION

It is an object to provide a safety apparatus, particularly to protect the nip of rotating cylinders, which does not require additional guide structures for the safety rail and still permits ready access to the cylinders for work on the cylinders when they are stationary. Preferably, the arrangement should be such that it can be easily interlocked with a safety circuit so that the printing machine can be started only when the safety rail is in position.

Briefly, the safety rail has projecting flanges attached thereto which are guided in an interengaging guide arrangement which are formed on the cover plates adjacent the cylinders, which are already present on printing machines. The interengaging guide means, for example, are guide slots cut into the cover plates in which the flanges engage. Preferably, one of the flanges is wrapped around the cover plate in U-shaped arrangement.

The flanges can be moved back and forth towards the nip and away therefrom, preferably in a descending linear path, and the position of the flanges and hence of the cover rail just in advance of the nip, or retracted therefrom, to provide access to the cylinders sensed, for example by limit switches engaging the flanges and/or other sensing elements coupled thereto. The limit positions of the flanges, and hence of the guard rails, can be set for example by end stops and/or spring-loaded positioning ball-and-detent arrangements or the like.

The arrangement has the advantage that access to the cylinders is readily available when the rails are removed from a position close to the nip. At the same time, a limit switch can be operated to inhibit printing machine operation so that no accidents can occur. The printing machine operating circuit is enabled only when the guard rail is in position, as sensed by an appropriate limit switch operated upon placement of the guard rail close to the nip.

DRAWINGS

FIG. 1 is a fragmentary end view of the safety guard rail and its holding and attachment arrangement; and FIG. 2 is a fragmentary highly schematic side view of the safety arrangement, applied between two cylinders and shown only in fragmentary representation.

DETAILED DESCRIPTION

Figure 2:
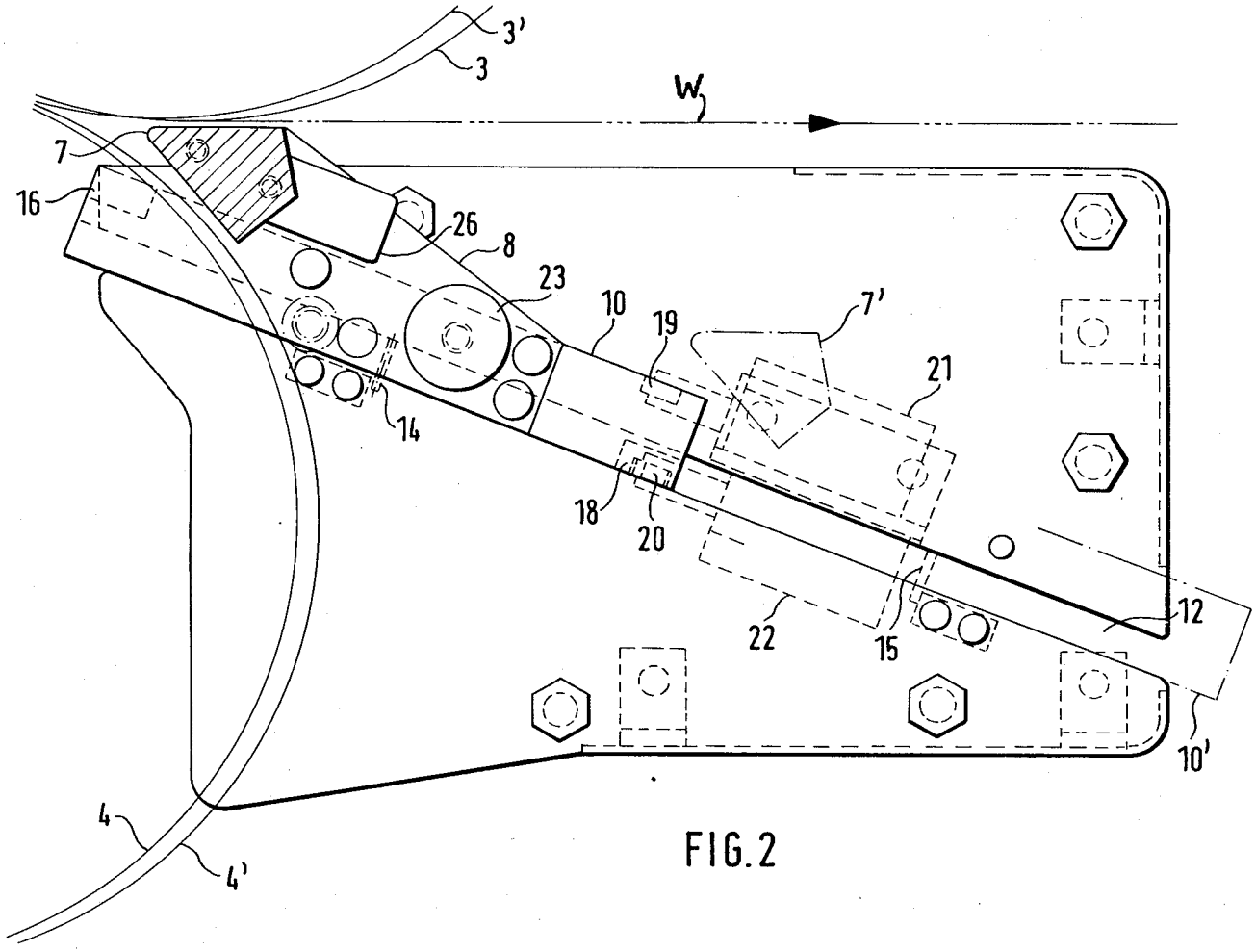

A standard printing machine having side walls 1, 2 and shown only schematically, retains therebetween two cylinders 3, 4 (see FIG. 2). These cylinders, for purposes of illustration, may for example both be blanket cylinders. The cylinders are retained in eccentrically positioned bearings - as well known, and not shown in the drawings. Thus, the position of the cylinders can be changed with respect to each other, for example from the position shown at 3 to 3', and at 4 to 4'.

An inlet gap or nip, which is essentially triangular, is protected against ingress of material other than a printing web, shown schematically only by the triple chain broken arrow line W, by an essentially triangular guard rail 7. Guard rail 7 is provided for safety; it is spaced from the circumference of the cylinders by a small gap, for example about 4 mm wide, and positioned parallel to the inlet or nip insertion region between the cylinders.

According to the present invention, the rail 7 is held in position by cover sheet or panel or plate elements 5, 6 which are located at the inside of the side walls 1, 2. These cover plates or panels 5, 6 are customarily present in the printing machines already. They are located, spaced by a predetermined distance from the inside wall, and held in position by suitable brackets. These cover plates are used to protect drive and control elements and structures which are necessary for operation of the printing machine.

In accordance with a feature of the invention, the rail 7 is coupled by an interengaging projection-and-recess arrangement with the cover plates. The rail 7 has flanges 8, 9 attached thereto which, at the side remote from the rail 7, are coupled to projecting guide structures 10, 11, which are retained within guide slits 12, 13, formed in the side cover plates or panels 5, 6, respectively.

The slits, generally, extend in a direction tangential to the cylinders 3, 4 at the position of the nip.

Preferably, the slits 12, 13 are inclined downwardly, that is, define a downwardly inclined guide track or plane. Thus, the rail 7 can be moved in an essentially linear path from a position close to the cylinders and close to the nip to a remote position, generally in line with the nip (see FIG. 2). Access to the cylinders is readily possible. FIG. 2 shows, in solid lines, the rail 7 and the guide 10 in position close to the nip between the cylinders, while the same elements are shown in chain-dotted configuration at 7' and 10' when in the remote position.

The rail 7 is preferably of approximately triangular cross section, as best seen in FIG. 2. One of the guides, for example guide element 11, is merely engaged in the respective slit 13 of the cover plate 6—see FIG. 1. The other guide element 10, however, engages through the associated slit 12 and surrounds the cover plate 6 in generally U-shaped configuration to insure reliable guidance of the rail 7 between the cylinder-adjacent and the remote positions, and to prevent possible misalignment or canting of the rail 7. Of course, the element 11 may, likewise, be formed with a U-shaped extension.

The limiting positions of the rail 7 are defined by end stops 14, 15 (FIG. 2). Stop 14 prevents engagement of the rail 7 with either one of the cylinders 3, 4, regardless of the cylinder positions. The stop 15 prevents inadvertent removal of the rail 7 from the guide arrangement; for replacement, the stop 15 may be removable. The guide element 10 includes control regions, preferably in form of recesses or openings 16, 18. Sensing feeler rollers 19, 20 of limit switches 21, 22 can engage in the recesses or openings 16, 18. FIG. 2 illustrates the position in which one of the limit switches, for example switch 21, which is operated by the associated roller 19, in ON; the other limit switch, then switch 22, and controlled by roller 20, is OFF since the roller 20 fits in the recess or opening 18. By suitable wiring, the conjunction of switch 21 ON and switch 22 OFF permits operation of the printing machine. Upon shift of the rail 7 into the position shown in chain-dotted lines at 7', and with the flange in the position at 10', both limit switches 21 and 22 will be controlled to be ON, for example commanding braking. When the rail has reached its second limiting or remote position, roller 19 can engage in the recess or opening 16 of the now shifted flange 10', so that switch 21 will be OFF and switch 22 will be ON. This is the reversal of the switch states in the operating position, and controls the machine to be held in stationary position, for example.

The respective positions of the rail 7, and hence of the flanges 8, 9, are controlled by stop knobs 23, 24, engaging through the side cover plates 5, 6. The stop knobs are spring-loaded and, for example, may include a pin engaging in an opening or depression of the side plates 5, 6, respectively, or may be spring-loaded ball-and-detent arrangements, as desired. The limit switches 21, 22 are held by respective brackets 25—see FIG. 1—in the space between the side wall 1 and the left cover plate 5. Handles, for example bent outwardly, of which one is shown at 26, FIG. 2, can be located on the rail 7 or on one or both of the extending flanges 8, 9 to facilitate shifting of the rail 7.

Figure 1:
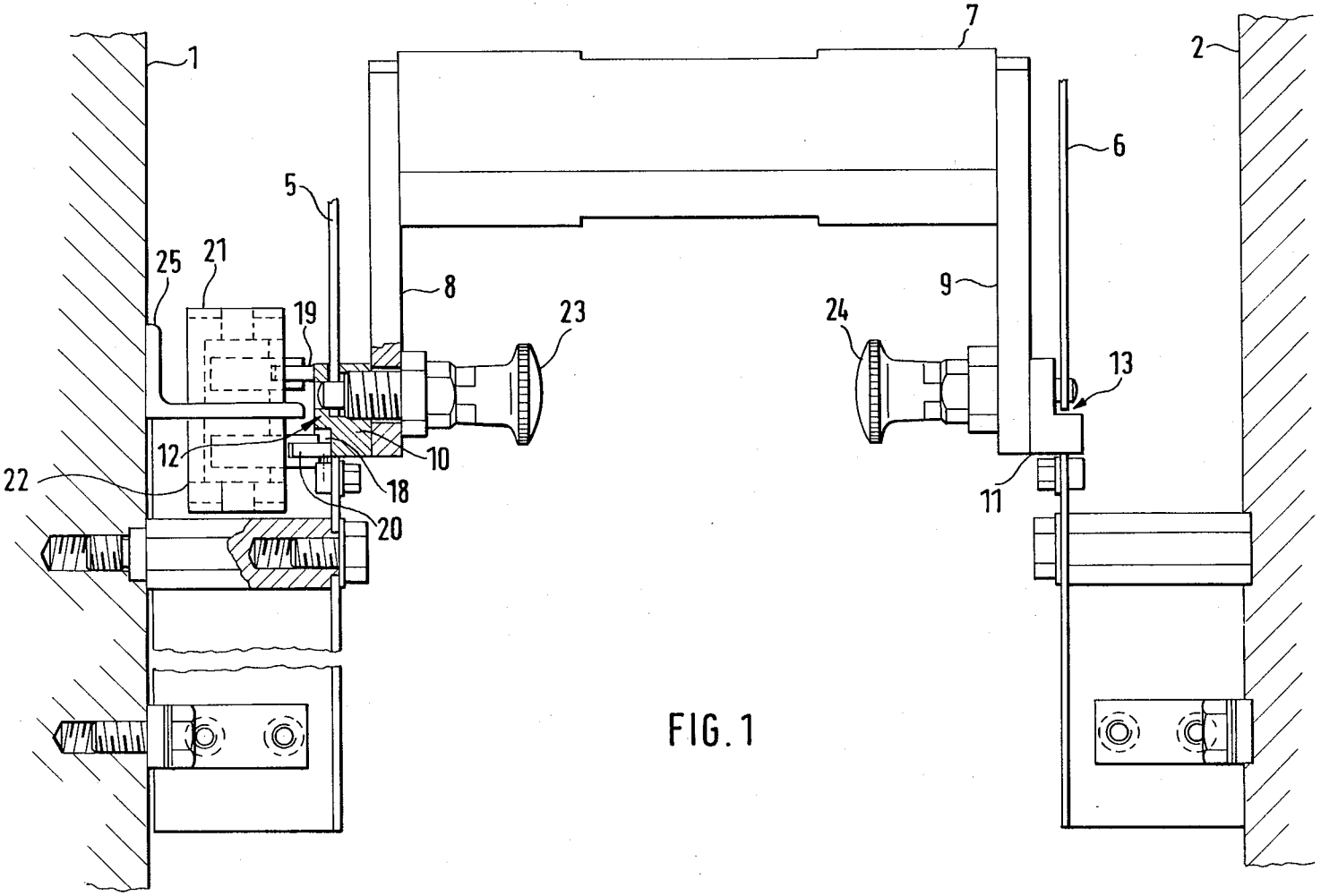

The arrangement, as best seen in FIG. 1, has the advantage that no additional guide structures are necessary for retention and shifting of the protective rail 7 between its protective or cylinder-adjacent position and the remote position. The guide slits 12, 13 can readily be formed in the cover plates or sheets 5, 6, which are present anyway in usual printing machines. The arrangement has a further advantage: The necessary guide and control elements are located in the space remote from the printing cylinders themselves, that is, in a space which is protected against dust, dirt and contamination since it is bounded between the side wall 1 of the printing machine and the cover plate 5 as such. Thus, interference with operating elements thereof and contamination by dirt and the like is effective eliminated.

Various changes and modifications may be made within the scope of the inventive concept.

What is claimed is:

1. A printing machine having side walls (1, 2);

two cylinders (3, 4) positioned to define a nip therebetween;

cover plates (5, 6) located laterally adjacent the cylinder end faces and positioned inside the side walls (1, 2), said cover plates serving to protect components of the printing machine;

an operator safety guard rail (7) located in advance of said nip; and means for securing said operator safety guard rail, adjustably and selectively, in position, wherein, accordance with the invention, said securing means comprises projecting flange elements (8, 9) secured to said safety guard rail (7) and extending essentially parallel to the cover plates (5, 6);

interengaging guide means (10, 11; 12, 13) formed, respectively, on said projecting flange elements (8, 9) on the cover plates (5, 6), and extending away from said nip in a direction generally tangential to said cylinders at said nip;

means (14, 15, 23) for selectively sliding said safety guard rail between an operating position closely adjacent said nip and a remote position, removed and remote from said nip, said safety guard rail being movable back and forth along said generally tangential direction; and limit switch means (21, 22) sensing the position of the safety guard rail with respect to said nip and providing, respectively, signals for permitting operation or inhibiting operation of the printing machine in dependence on the position of said safety guard rail with respect to said nip.

2. The machine of claim 1, wherein the interengaging guide means comprises guide slits (12, 13) formed in said side plates (5, 6), and engaging guide elements secured to said projecting flange elements (8, 9) and engageable in said guide slits.

3. The machine of claim 2, wherein at least one of said engaging guide elements passes through the respective guide slit and around a remote surface of the cover plate.

4. The machine of claim 3, wherein said control means comprises depressed regions (16, 18) formed in said at least one guide means;

and wherein said limit switch means (21, 22) includes feeler elements (19, 20) engageable in said depressed regions.

5. The machine of claim 3, wherein said sliding means further includes spring-loaded stop knobs (23) for positively positioning the projecting flange elements, and hence the safety guard rail, selectively, in said operating position and in said remote position, and engageable with the cover plates (5, 6).

6. The machine of claim 2, wherein at least one of said guide elements includes control means (16, 18) engageable with and controlling the operation of said limit switch means (21, 22).

7. The machine of claim 6, wherein said control means comprises depressed regions (16, 18) formed in said at least one guide means;

and wherein said limit switch means (21, 22) includes feeler elements (19, 20) engageable in said depressed regions.

8. The machine of claim 6, wherein said sliding means further includes spring-loaded stop knobs (23) for positively positioning the projecting flange elements, and hence the safety guard rail, selectively, in said operating position and in said remote position, and engageable with the cover plates (5, 6).

9. The machine of claim 2, wherein said interengaging guide means are located in a downwardly inclined plane, and the positioning means include at least one stop element (14) located at an upper region of said interengaging guide means for positioning of the safety guard rail (7) in the operating position adjacent said nip.

10. The machine of claim 2, wherein said sliding means further includes spring-loaded stop knobs (23) for positively positioning the projecting flange elements, and hence the safety guard rail, selectively, in said operating position and in said remote position, and engageable with the cover plates (5, 6).

11. The machine of claim 1, wherein said interengaging guide means are located in a downwardly inclined plane, and the positioning means include at least one stop element (14) located at an upper region of said interengaging guide means for positioning of the safety guard rail (7) in the operating position adjacent said nip.

12. The machine of claim 11, wherein at least one of said engaging guide elements passes through the respective guide slit and around a remote surface of the cover plate.

13. The machine of claim 12, wherein said control means comprises depressed regions (16, 18) formed in said at least one guide means;

and wherein said limit switch means (21, 22) includes feeler elements (19, 20) engageable in said depressed regions.

14. The machine of claim 11, wherein said sliding means further includes spring-loaded stop knobs (23) for positively positioning the projecting flange elements, and hence the safety guard rail, selectively, in said operating position and in said remote positions, and engageable with the cover plates (5, 6).

15. The machine of claim 1, wherein said sliding means further includes spring-loaded stop knobs (23) for positively positioning the projecting flange elements, and hence the safety guard rail, selectively, in said operating position and in said remote position, and engageable with the cover plates (5, 6).

16. The machine of claim 7, wherein said sliding means further includes spring-loaded stop knobs (23) for positively positioning the projecting flange elements, and hence the safety guard rail, selectively, in said operating position and in said remote position, and engageable with the cover plates (5, 6).

17. The machine of claim 1, wherein said interengaging engaging guide means comprises at least one guide slit (12, 13), and at least one guide element (10) of generally U-shaped configuration secured to at least one of said flange elements (8, 9), extending through a respective one of said guide slits.

18. The machine of claim 1, wherein said interengaging guide means comprises guide slits (12, 13) formed in said cover plates (5, 6), and at least one guide element (10) of generally U-shaped configuration secured to at least one of said projecting flange elements (8, 9), and extending through a respective one of said guide slits and around a remote surface of the respective cover plate.

19. The machine of claim 18, wherein two guide elements are provided, one, each, extending into a respective guide slit (12, 13);

and wherein at least one of said guide elements includes control means (16, 18) engageable with and controlling the operation of said limit switch means (21, 22).

20. The machine of claim 18, wherein said guide slits are located in a downwardly inclined plane.

* * * * *